US007221893B2

(12) United States Patent
Nishikawa

(10) Patent No.: US 7,221,893 B2
(45) **Date of Patent: *May 22, 2007**

(54) IMAGE FORMING APPARATUS

(75) Inventor: Satoru Nishikawa, Ebina (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 11/053,844

(22) Filed: Feb. 10, 2005

(65) Prior Publication Data

US 2006/0067743 A1 Mar. 30, 2006

(30) Foreign Application Priority Data

Sep. 24, 2004 (JP) ..... 2004-278045

(51) Int. Cl.
*G03G 15/01* (2006.01)
*G03G 15/00* (2006.01)

(52) U.S. Cl. ..... 399/301; 399/384; 399/164; 399/165

(58) Field of Classification Search ..... 399/301, 399/384, 160, 164, 165
See application file for complete search history.

(56) References Cited

U.S. PATENT DOCUMENTS 5,828,937 A * 10/1998 Aerens et al. ..... 399/301
6,292,649 B1 * 9/2001 Toyama et al. ..... 399/384
6,553,206 B2 * 4/2003 Asuwa et al. ..... 399/384
2003/0228182 A1 * 12/2003 Matsuduki ..... 399/384

FOREIGN PATENT DOCUMENTS

JP 6-64244 A 3/1994

* cited by examiner

*Primary Examiner*—David M. Gray
*Assistant Examiner*—Joseph S. Wong
(74) *Attorney, Agent, or Firm*—Oliff & Berridge, PLC

(57) ABSTRACT

In an image forming apparatus such as a color laser printer wherein a toner image is transferred onto a continuous paper, one or more of a exposure timing of each exposure device, a rotation speed of each image carrier device, a transfer bias voltage applied to each transfer device, and a wrap amount of each wrap device are controlled based on a coverage of a toner image formed on each image carrier device, thereby preventing a color-to-color registration state which tends to be caused due to a variation in the transport speed of the continuous paper in a transfer process.

9 Claims, 10 Drawing Sheets

IMAGE FORMING APPARATUS

CROSS-REFERENCE TO RELATED APPLICATION

This application claims priority under 35 USC 119 from Japanese Patent Application No. 2004-278045, the disclosure of which is incorporated by reference herein.

BACKGROUND OF THE INVENTION

1. Field of the Invention

The present invention relates to an image forming apparatus, and more particularly to an image forming apparatus using a continuous paper transported as a recording medium and which is designed so as to prevent a color-to-color misregistration state which tends to be caused due to a variation in the transport speed of the continuous paper when respective color toner images are transferred onto the continuous paper.

2. Description of the Related Art

In a tandem type color laser printer, photoreceptor drums carrying toner images of respective colors (cyan, magenta, yellow, black, and so forth) are provided along a transport path for a recording medium. Each of the photoreceptor drums is arranged such that after a surface thereof is charged by a charger, a surface potential is decreased by means of an exposure device so that a latent image is formed thereon. The latent image is developed into a toner image by means of a development device. Then, the toner image carried by each photoreceptor drum is transferred onto the recording medium by means of a transfer device.

Among such tandem type color laser printers is one which uses a continuous paper as a recording medium.

As will be understood, it is required that toner images on respective photoreceptor drums be sequentially transferred in precise registration onto the continuous paper, thereby preventing a color-to-color misregistration state of the toner images. In order to satisfy such a requirement, in a tandem type color laser printer using a continuous paper, it has so far been proposed to apply a tension to the continuous paper so that the continuous paper is tensioned before and after the transfer, thereby preventing a color-to-color misregistration state of toner images from being caused because of the continuous paper going slack or getting wrinkled (for example, refer to JP-A No. 6-64244).

However, it has sometimes happened that a color-to-color misregistration state is caused despite application of a tension to the continuous paper The inventor has conducted an analysis of color-to-color misregstration states, and found out causes for such states as mentioned below.

When a toner image on a photoreceptor drum is transferred onto a continuous paper, since that portion of the photoreceptor drum's surface where no toner image is formed is charged, the continuous paper is electrostatically attracted to the photoreceptor drum. Furthermore, since a coverage of the toner image (a proportion of area occupied by the toner image) differs from one photoreceptor drum to another, the electrostatic force of attraction of the continuous paper also differs from one photoreceptor drum to another.

For this reason, a tension applied to the continuous paper between adjacent ones of the photoreceptor drums is varied so that tensions applied to the continuous paper between the respective photoreceptor drums become nonuniform. Consequently, the transport speed of the continuous paper is varied, and the variation in the transport speed of the continuous paper causes a color-to-color misregistration state in a transfer process.

SUMMARY OF THE INVENTION

The present invention has been made with a view to solving the above-described problems, and provides an apparatus that enables toner images to be transferred in precise registration onto a continuous paper.

According to an aspect of the present invention, an image forming apparatus includes a print section including plural print units arranged along a transport path for a continuous paper for sequentially transferring respective color toner images in registration onto the continuous paper, wherein each of the plural print units includes a rotatable image carrier device, a charger device for charging a surface of the image carrier device at a predetermined surface potential, an exposure device for exposing the image carrier device so as to decrease the surface potential thereby causing a latent image to be formed on the image carrier device, a development device for developing the latent image on the image carrier device into a toner image, and a transfer device disposed to face the image carrier device across the transport path for the continuous paper therefrom for causing the toner image on the image carrier device to be transferred onto the continuous paper; a continuous paper transport section provided on an upstream side of a transport direction of the continuous paper for transporting the continuous paper toward the print section; a fixing section provided on a downstream side of the transport direction of the continuous paper for fixing unfixed toner images onto the continuous paper, the unfixed toner images being formed at the print section and transferred onto the continuous paper; a tensioning mechanism for imparting a predetermined tension to the continuous paper having the toner images fixed thereon; and a control unit for preventing a color-to-color misregistration state which tends to occur when respective color toner images are sequentially transferred to be overlaid onto the continuous paper.

Other objects, features and advantages of the present invention will become to a person of ordinary skill in the art from the following description taken in conjunction with the accompanying drawings.

BRIEF DESCRIPTION OF THE DRAWINGS

Embodiments of the present invention will be described in detail based on the following figures, wherein.

DETAILED DESCRIPTION OF THE INVENTION

Figure 1:
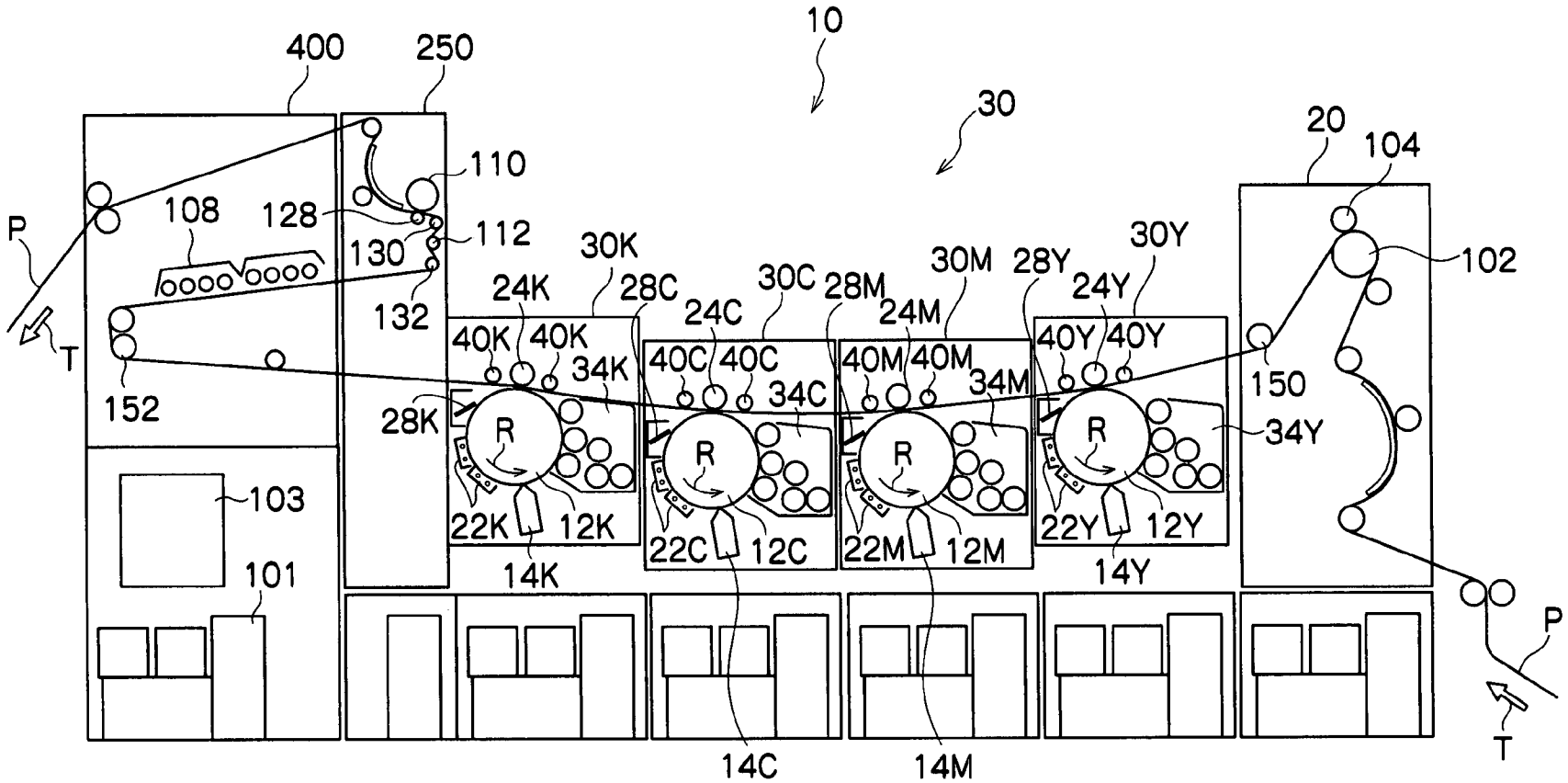
FIG. 1 is a schematic view showing a color laser printer according to an embodiment of the present invention.

As shown in FIG. 1, a color laser printer 10 serving as an image forming device performs image formation by an electrophotographic process. The color laser printer 10 includes a control portion 101 for controlling the whole of the color laser printer 10. On an exterior package of the color laser printer 10 is provided an operation panel 103 for providing various information displays and carrying out various operations of the color laser printer 10.

Also, as shown in FIG. 1, the color laser printer 10 includes a print section 30 for transferring toner images of respective colors such as yellow (Y), magenta (M), cyan (C) and black (K) in the named order to a continuous paper P and superimposing the toner images upon each other. The print portion 30 includes print units 30Y, 30M, 30C and 30K for the respective colors such as yellow (Y), magenta (M), cyan (C) and black (K), which are arranged in this order along a transport passageway from upstream to downstream in the transport direction. Hereinafter, when a distinction among YMCK is required, a corresponding one of the suffixes Y, M, C, and K will be added to the reference numeral for convenience of explanation, while when such a distinction is not required, the suffixes will be omitted.

A paper transport section 20 for transporting continuous paper P to the print section 30 is provided at the upstream side of the print section 30 as viewed in the transport direction. Further, at the downstream side of the print section as viewed in the transport direction, a fixing section 400 is provided which operates to fix to the continuous paper P, the unfixed full-color toner images which are formed at the respective print units 30Y–K and transferred to the continuous paper P.

Figure 2:
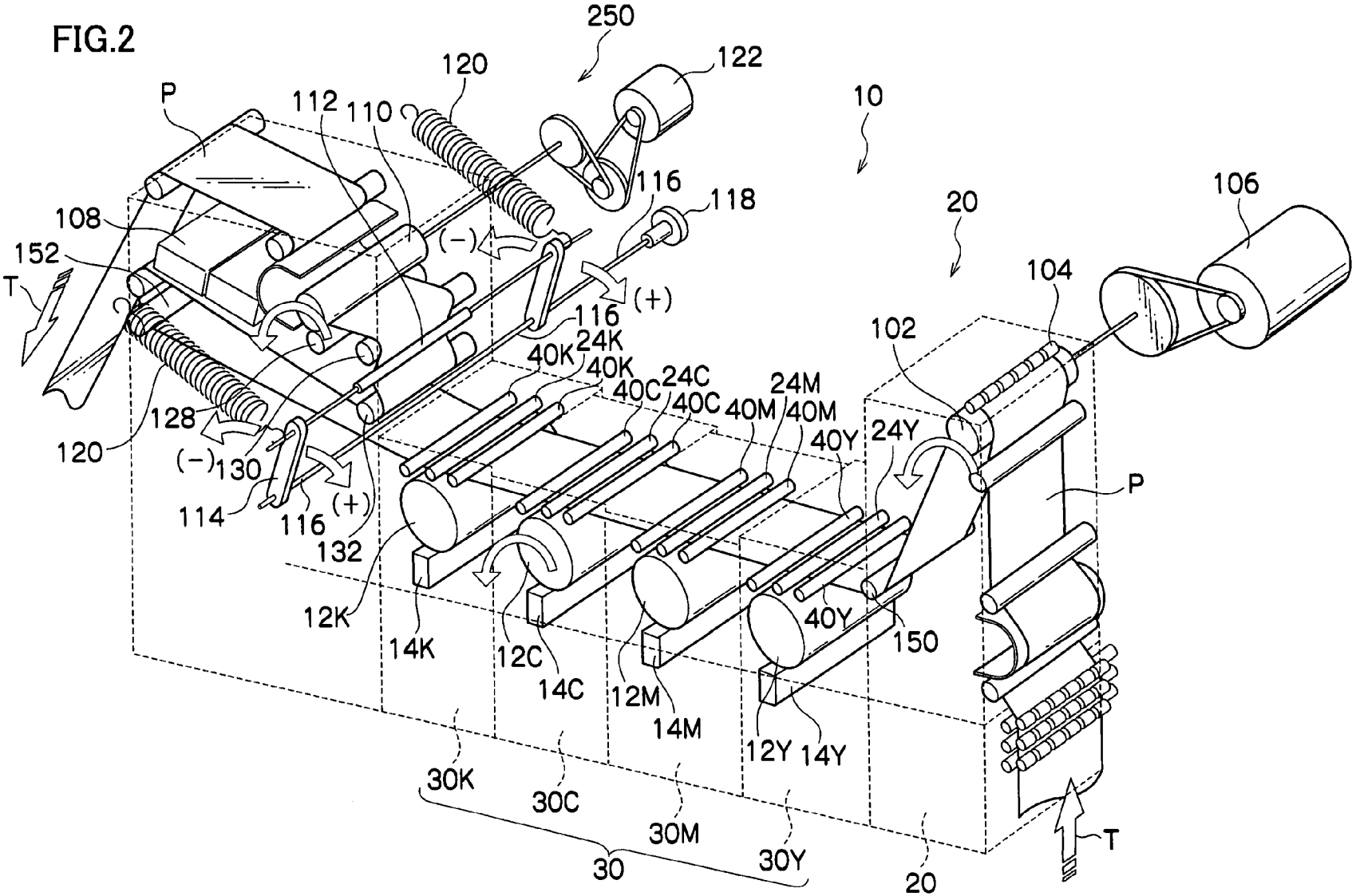
FIG. 2 is a schematic perspective view showing the color laser printer of FIG. 1.

As shown in FIG. 2, the paper transport section 20 includes a main drive roller 102 around a part of which the continuous paper P is wrapped. An idle roller 104 is disposed in contact with the main drive roller 102 in such a manner as to pinch the continuous paper P at a nip portion between the main drive roller 102 and the idle roller 104, thereby permitting the continuous paper P to be transported. Further, the main drive roller 102 is normally driven at a constant speed by means of a main drive motor 106, and this speed constitutes a reference for the transport speed of the continuous paper P transported through the apparatus.

Furthermore, as shown in FIG. 1, the print units 30Y–K respectively include photoreceptor drums 12Y–K around which are provided chargers 22Y–K, LED heads 14Y–K, developing units 34Y–K, transfer rollers 24Y–K, cleaning units 28Y–K, and neutralization chargers (not shown) in the named order as viewed in the rotational direction of the photoreceptor drums.

Figure 4:
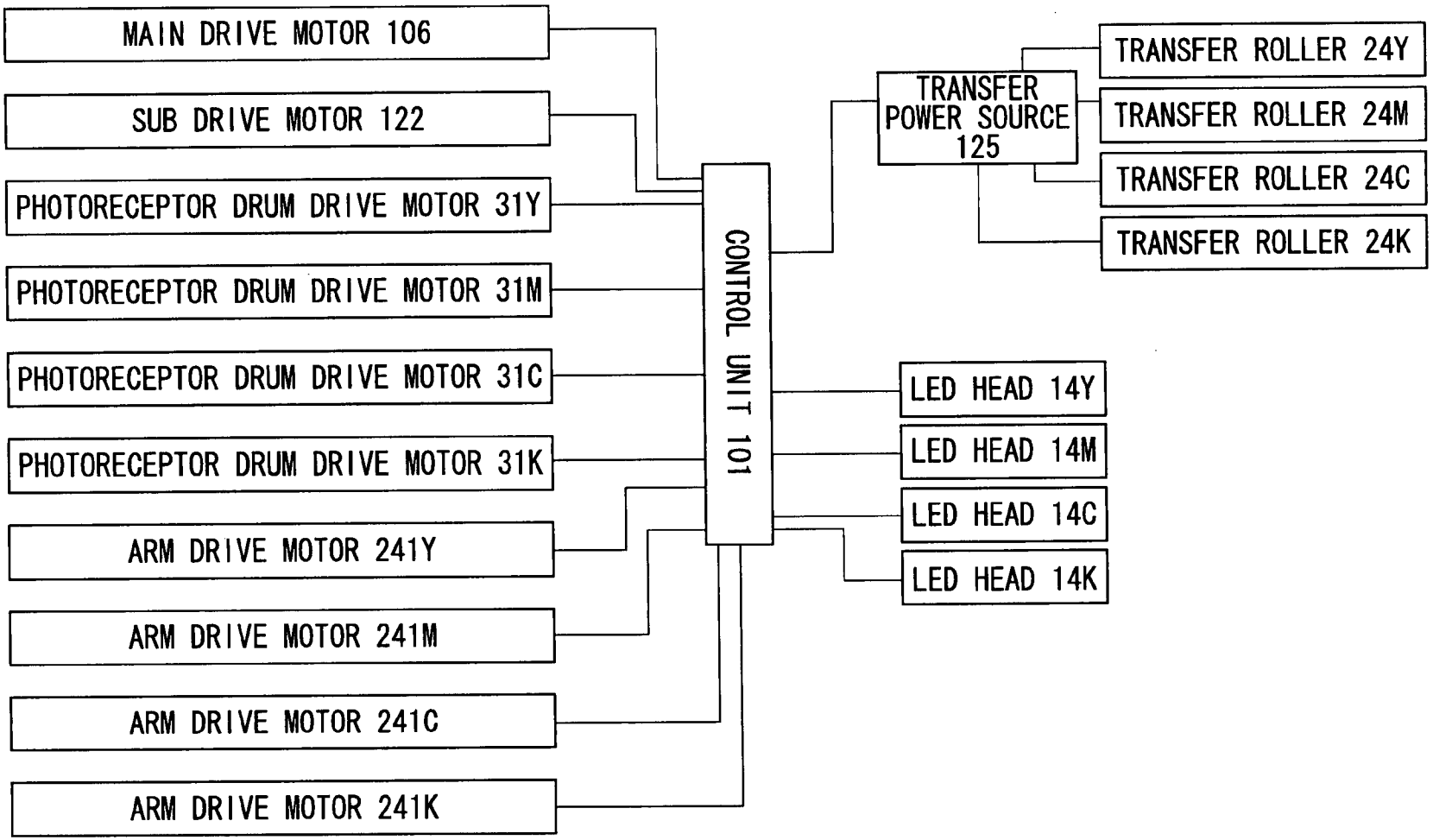
FIG. 4 is a block diagram illustrating a color laser printer.

As shown in FIG. 4, the photoreceptor drums 12Y–K are rotated by photoreceptor drum driving motors 31Y–K each including a stepping motor, and the photoreceptor drum driving motors 31Y–K are controlled in terms of rotation speed by a pulse inputted from the control unit 101 thereto. It is arranged such that each of the photoreceptor drums 12Y–K is driven by a respective one of the photoreceptor drum driving motors 31Y–K so that the photoreceptor drums 12Y–K can be rotated at different speeds.

As shown in FIG. 1, the chargers 22Y–K cause the surfaces of the respective photoreceptor drums 12Y–K to be charged at a predetermined surface potential. The LED heads 14Y–K line-expose the surfaces of the photoreceptor drums 12Y–K, and thus decrease the surface potentials thereof, thereby forming latent images. Meanwhile, as shown in FIG. 4, the respective LED heads 14Y–K are individually controlled by the control unit 101 so that the exposure timings (write-in timings) of the respective LED heads 14Y–K are individually controlled by the control unit 101. Further, the exposure device may use other components than the LED heads 14. For example, the exposure device may be an optical scanning device arranged to perform exposure by scanning laser light.

In this manner, as shown in FIG. 1, the developing units 34Y–K cause toners to be adhered onto the latent images formed on the photoreceptor drums 12Y–K, thereby forming toner images.

The transfer rollers 24Y–K are disposed in contact with the top surfaces of the photoreceptor drums 12Y–K with the continuous paper P held therebetween, thereby transporting the continuous paper P in cooperation with the photoreceptor drums 12Y–K. During the holding and transporting operation, the transfer rollers 24Y–K are applied with a transfer bias voltage by a transfer power source 125 (see FIG. 4), so that the latent images formed on the photoreceptor drums 12Y–K are transferred onto the continuous paper P. Meanwhile, as shown in FIG. 4, the transfer power source 125 is controlled by the control unit 101, and thus the transfer bias voltage applied to the transfer rollers 24Y–K is controlled. In this regard, it is possible that different transfer bias voltages may be applied to the transfer rollers 24Y–K respectively.

Figure 3B:
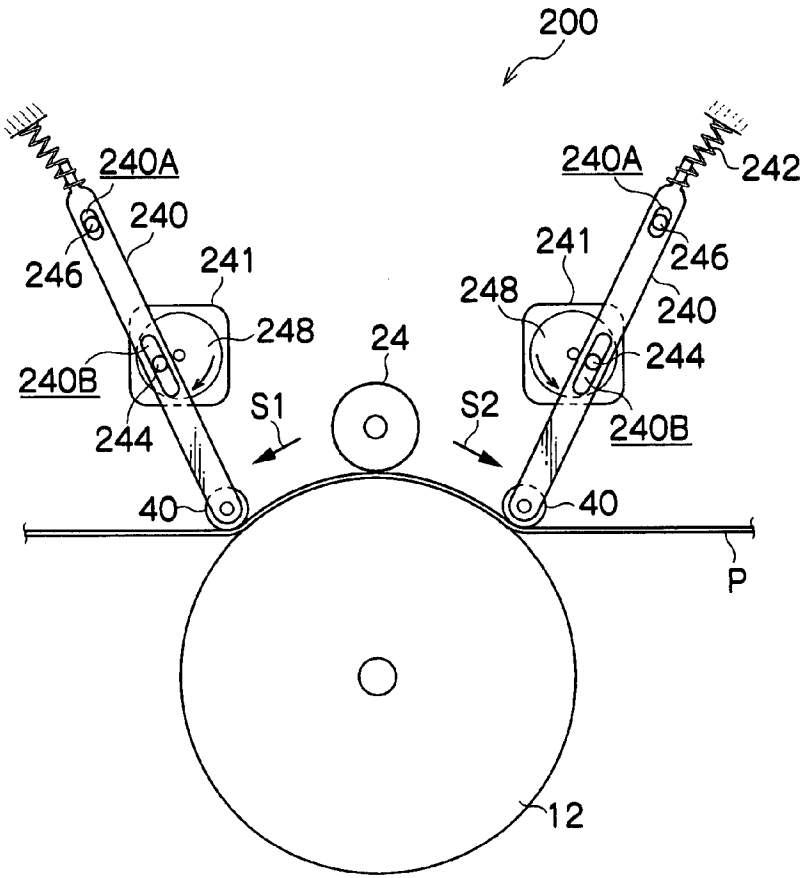
FIG. 3B shows a wrap device for use in the color laser printer according to an embodiment of the present invention, wherein an increased amount of wrap is provided.
Figure 3A:
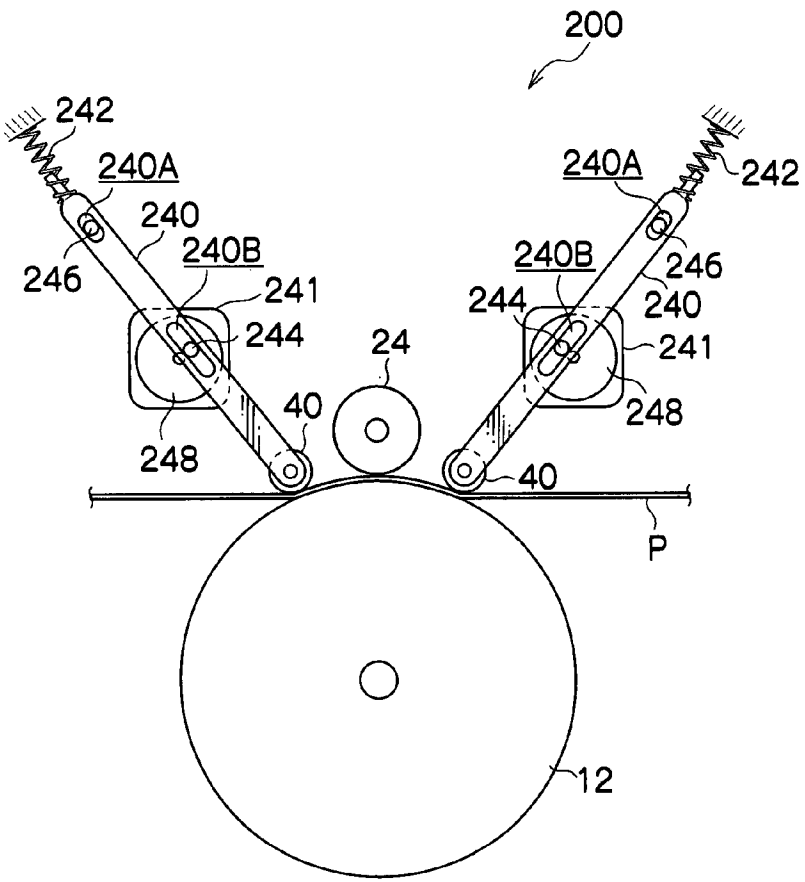
FIG. 3A shows a wrap device for use in the color laser printer according to an embodiment of the present invention, wherein a small amount of wrap is provided.

FIG. 3 shows a wrap device 200 for enabling the continuous paper P to be wrapped around a part of the photoreceptor drum 12. The wrap device 200 includes two stabilizer rollers 40 which are disposed on the downstream and upstream sides of the transfer roller 24 as viewed in the transport direction. The continuous paper P is wrapped around a part of the circumferential surface of the photoreceptor drum 12 near the transfer roller, thereby stabilizing the transfer of the toner image on the photoreceptor drum 12 onto the continuous paper P.

Each of the stabilizer rollers 40 is rotatably attached to an end of an arm 240 which is biased at the other end by means of a spring 242 so that each stabilizer roller 40 is pressed against the photoreceptor drum 12. Each arm 240 has an elongated aperture 240B formed at a center portion thereof and another elongated aperture 240A at the other end. A shaft 246 attached to a support member (not shown) is inserted through the elongated aperture 240A formed at the other end of the arm 240.

Another shaft 244 is inserted through the elongated aperture 240B formed in the center portion of the arm 240. The shaft 244 is formed on a rotary plate 248 attached to a rotary shaft of an arm driving motor 241 which is a stepping motor.

Thus, as shown in FIG. 3B, when the rotary plate 248 is rotated by the arm driving motor 241, the pair of arms 240 are displaced in directions S1 and S2 respectively so that the stabilizer rollers 40 are moved away from each other. Consequently, the amount of the continuous paper P that is wrapped around a part of the circumferential surface of the photoreceptor drum 12 is increased. As shown in FIG. 4, the angle of rotation of each of the arm driving motors 241Y–K, i.e., the wrapping amount, is individually controlled by the control unit 101.

The wrap device that partially wraps each photoreceptor drum 12 in the continuous paper P may be a mechanism other than the wrapping mechanism 200, which may be any mechanism capable of causing the continuous paper P to be wrapped around a part of the photoreceptor drum 12 and adjusting the wrapping amount.

As shown in FIG. 1, non-transferred residual toners remaining on the surfaces of the photoreceptor drums 12Y–K without being transferred to the continuous paper P are removed by the cleaning units 28Y–K.

The continuous paper P having toner images transferred thereto is transported to the fixing section 400 so that the toner images of the continuous paper P are heated and melted by a flash fixing device 108 so as to be fixed onto the continuous paper P. The continuous paper P, which has been subjected to the fixing process, is transported to a tensioning mechanism 250.

As shown in FIG. 2, the tensioning mechanism 250 includes idle rollers 132 and 130 about which the continuous paper P is entrained.

A tensioning roller 112 is provided between the idle rollers 132 and 130. The tensioning roller 112 is supported at each of its axially opposite ends by one end of each of arms 114. A shaft 116 extend through the other ends of the arms 114 so that the arms 114 are rocked about the shaft 116. The arms 114 are biased toward the continuous paper P side by springs 120 so that the tensioning roller 112 is biased toward the continuous paper P. In this manner, a tension is imparted to the continuous paper P.

Further, a sub-drive roller 110 and an idle roller 128 are provided at the downstream side of the idle roller 130. The sub-drive roller 110 is driven by a sub-drive motor 122 so that the continuous paper P is transported with the aid of the sub-drive roller 110 and idle roller 128 while being held therebetween. Meanwhile, as shown in FIG. 4, the sub-drive motor 122 is controlled in terms of rotation speed by the control unit 101.

Further, as shown in FIG. 2, the rotation angle of the arms 114 is detected by an encoder 118 mounted on an end of the shaft 116, and the result of detection is passed to the control unit 101 (see FIG. 1). The control unit 101 controls the rotation speed of the sub-drive motor 122 so that the arms 114 are located at a predetermined position at all times. That is, the rotation speed of the sub-drive motor 122 is determined from a tension of the continuous paper P which is detected based on the position of the tensioning roller 112.

More specifically, as the tension of the continuous paper P is increased, the amount of sag of the continuous paper P is decreased so that the tension roller 112 is pushed in a direction such that the continuous paper P does not sag (rightward as viewed in the drawing). As a result of this, the arms 114 are also rotated rightward as viewed in the drawing, and a signal indicative of a plus direction (the tension being strong) is detected at the encoder 118.

By providing a feedback corresponding to this signal to the sub-drive motor 122 to thereby decrease the rotation speed of the sub-drive roller 110, the transport speed of the continuous paper P is decreased, and consequently the amount of sag of the continuous paper P is increased so that the tensioning roller 112 is rotated in a direction such as to push in the continuous paper P (leftward as viewed in the drawing).

On the other hand, as the tension of the continuous paper P is decreased, the amount of sag of the continuous paper P is increased so that the tensioning roller 112 is drawn in a direction such that the continuous paper P is caused to sag (leftward as viewed in the drawing). Thus, the arms 114 are also rotated leftward as viewed in the drawing and a signal indicative of a minus direction (the tension being weak) is detected at the encoder 118.

By providing a feedback corresponding to this signal to the sub-drive motor 122 to thereby increase the rotation speed of the sub-drive roller 110, the transport speed of the continuous paper P is increased, and consequently the amount of sag of the continuous paper P is decreased so that the tensioning roller 112 is rotated in a direction such as to be pushed by the continuous paper P (rightward as viewed in the drawing).

Through repetition of the above-mentioned process, the sub-drive motor 110 is operated, while changing its rotation speed, to cause the continuous paper P to be transported in such a manner that the tensioning roller 112 assumes a fixed position, i.e., the tension of the continuous paper P is kept constant.

The tensioning mechanism for imparting a predetermined tension to the continuous paper P may be any suitable mechanism other than the tensioning mechanism 250.

The continuous paper P is ejected out of the apparatus from the tensioning mechanism 250. Description will now be made of the printing operation of the color laser printer 10.

Formation of a toner image onto the photoreceptor drum 12 will first be described. The charger 22 causes the surface of the photoreceptor drum 12 to be uniformly charged at a predetermined surface potential. Subsequently, exposure is provided by the LED head 14, and the surface potential at the exposed position of the photoreceptor drum 12 is decreased, thus resulting in an electrostatic latent image being formed on the surface of the photoreceptor drum 12. Then, the electrostatic latent image is developed by the developing unit 34 into a toner image.

In the color laser printer 10 which is designed to perform multi-color full-color image formation, an adjustment is made of a timing that is set by taking into account of differences in relative position among the print units 30Y–K, e.g., of an exposure timing with which each of the LED heads 14Y–K provides exposure to form a latent image, and a toner image forming step similar to that described above is carried out at each of the photoreceptor drums 12Y–K.

Then, the control unit 101 operates such that a transfer bias voltage is applied to each of the transfer rollers 24Y–K with a predetermined timing and toner images formed on the photoreceptor drums 12Y–K in respective colors such as yellow, magenta, cyan, and black are sequentially transferred onto the continuous paper P in a superposed relationship with each other, thereby forming a full-color toner image on the continuous paper P.

When the continuous paper P is transported until the head of the area where the full-color unfixed toner image formed on the continuous paper P reaches an entrance to an infrared ray irradiation area of the flash fixing device 108, the control unit 101 causes flash lamps to irradiate infrared rays. Thus, when passing through the infrared ray irradiation area of the flash fixing device 108, the unfixed toners on the continuous paper P are melted by being heated by infrared rays irradiated from the flash lamps, and solidified to be fixed on the continuous paper P after having passed through the infrared ray irradiation area.

The operation of this embodiment will next be described.

Figure 5:
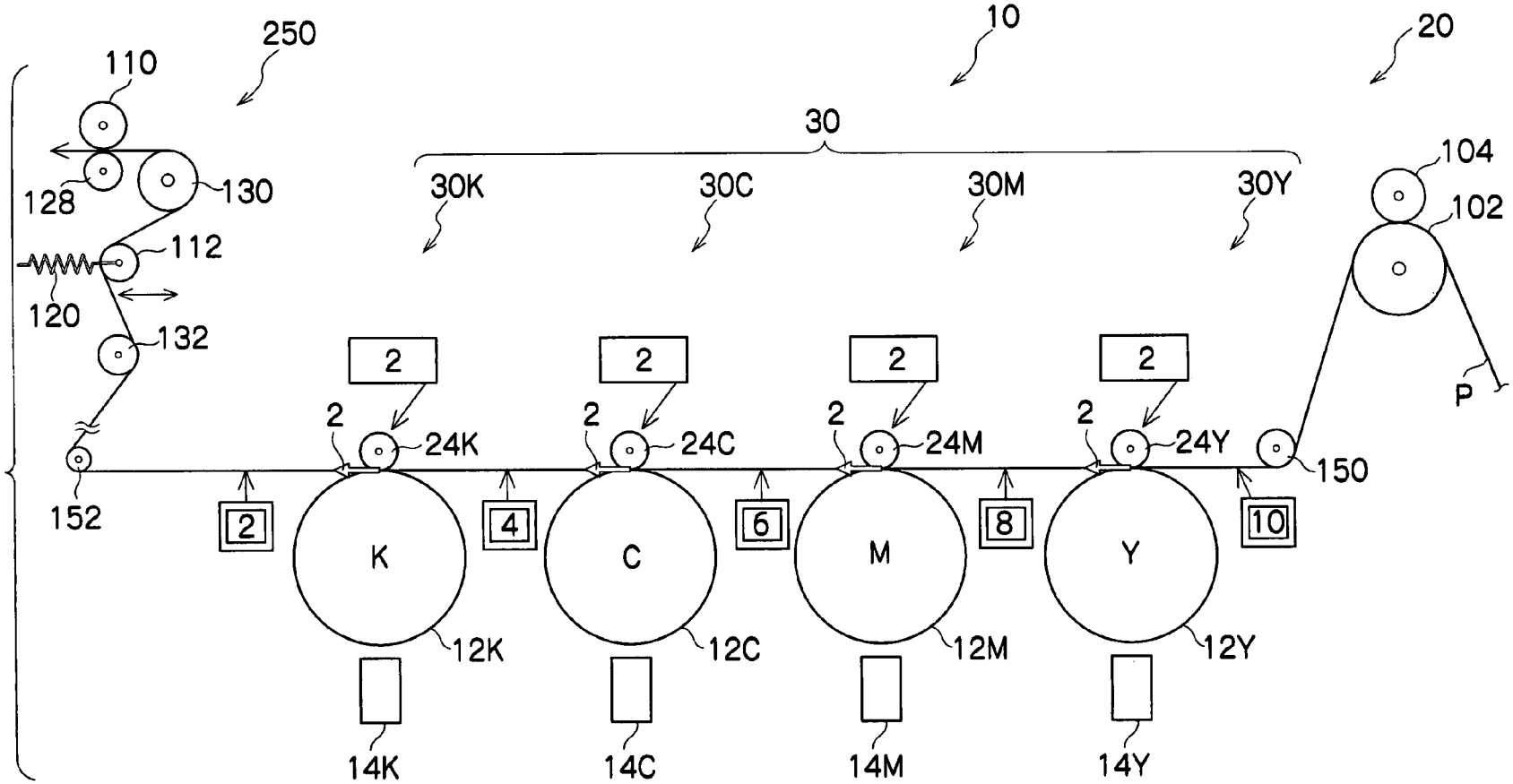
FIG. 5 is a view useful for explaining about electrostatic forces of attraction and tensions which are provided when the coverages of toner images on all photoreceptor drums have a reference value.

The tensioning mechanism 250 imparts a predetermined tension to the continuous paper P, as mentioned above. Further, tensions applied to the continuous paper P between the respective photoreceptor drums 12Y–K, between the photoreceptor drum 12Y and the idle roller 150, and between the photoreceptor drum 12K and the idle roller 152 as shown in FIG. 5 are equal, and the transport speed of the continuous paper P is also kept constant. In contrast thereto, if such tensions are unequal, the transport speed is not kept constant.

When a toner image on the photoreceptor drum 12 is transferred onto the continuous paper P, that portion of the photoreceptor drum 12 on which no toner image is formed is charged at a given surface potential so that the continuous paper P is electrostatically attracted to the surface of the photoreceptor drum 12.

Figure 6:
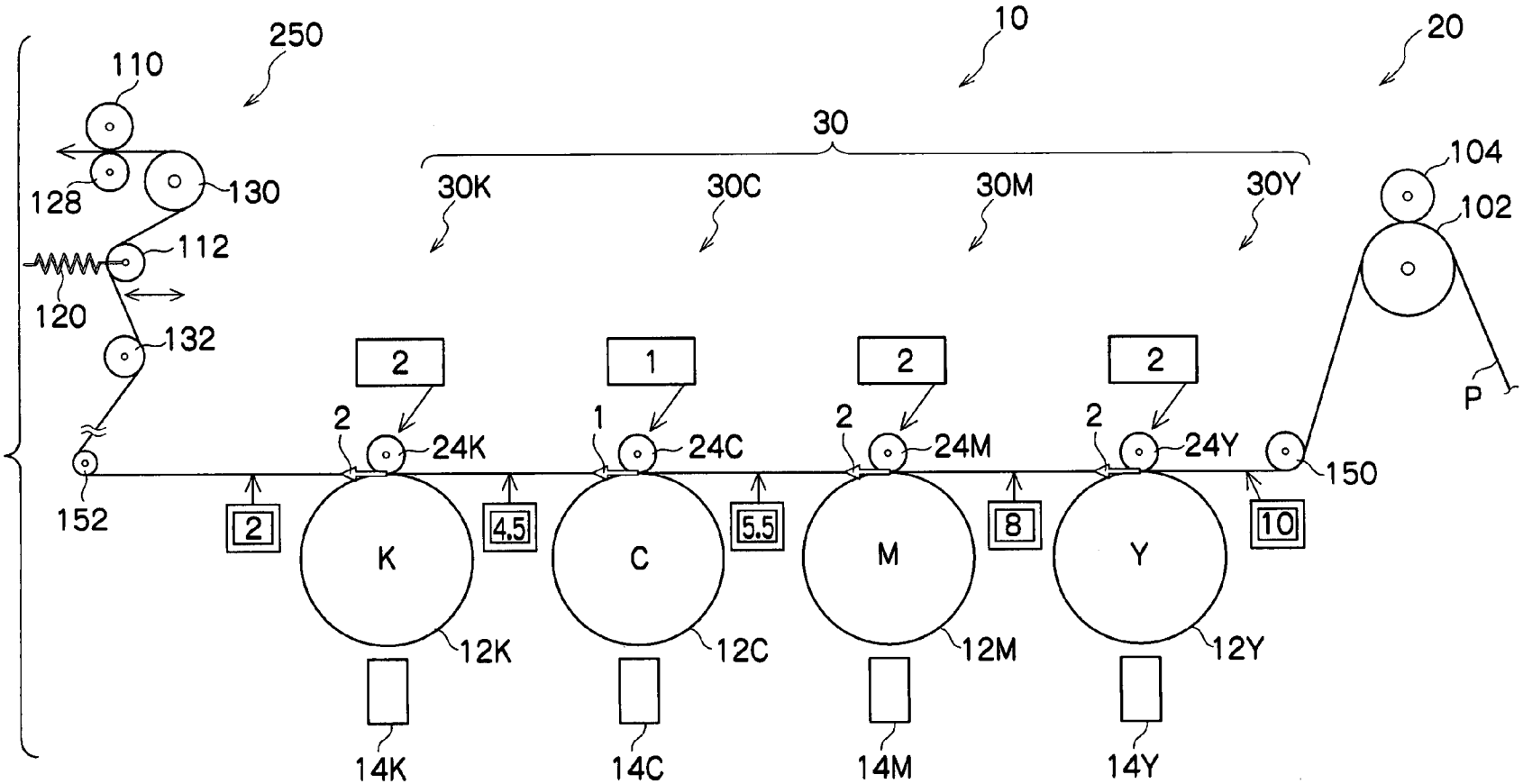
FIG. 6 is a view useful for explaining about an electrostatic force of attraction and a tension which are provide when the coverage of a toner image on the cyan photoreceptor drum alone has a value greater than a reference value.

However, the coverage of a toner image (the proportion of the area occupied by the toner image) differs from one image formed to another, and also among the respective photoreceptor drums 12Y–K. Accordingly, the electrostatic force of attraction with which the continuous paper P is attracted to the surface of the photoreceptor drum 12 also differs among the respective photoreceptor drums 12Y–K. Thus, the transporting force with which the continuous paper P is transported while being held between the respective photoreceptor drums 12Y–K and the respective transfer rollers 24Y–K also differs among the photoreceptor drums 12Y–K. Consequently, tensions which the tensioning mechanism 250 applies to the continuous paper P between adjacent ones of the photoreceptor drums 12Y–K, between the photoreceptor drum 12Y and the idle roller 150 and between the photoreceptor drum 12K and the idle roller 152 are varied and become unequal as shown in FIG. 6. For this reason, the transport speed of the continuous paper P is varied. Disadvantageously, this variation in the transport speed of the continuous paper P results in a color-to-color misregistration state that respective color toner images are out of registration. Stated differently, differences in coverage among color toner images formed on the photoreceptor drums 12Y–K cause a color-to-color misregistration state.

Therefore, the control unit 101 controls one or more of the following items, based on the coverage of each of respective color toner images formed on the respective photoreceptor drums 12Y–K, thereby preventing a color-to-color misregistration state:

(1) the exposure timing of each of the LED heads 14Y–K;
(2) the rotation speed of each of the drum driving motors 31Y–K, or the rotation speed of each of the photoreceptor drums 12Y–K);
(3) the transfer bias voltage applied to each of the transfer rollers 24Y–K; and
(4) the rotation angle of each of the arm driving motors 41Y–K, or the amount of wrap of the continuous paper P due to the stabilizer rollers 40Y–K.

What has been mentioned above will be described below more specifically. While the photoreceptor drum 12C will be explained below by way of example, the following explanation will also apply to each of the other photoreceptor drums 12Y, 12M, and 12K.

FIG. 5 illustrates a case where all the coverages are at a predetermined reference level, wherein it is assumed that a reference electrostatic force of attraction with which the continuous paper P is electrostatically attracted to the photoreceptor drums 12Y–K is 2 (the numeral enclosed by a double square in the drawing). Further, assuming that a total of the tensions applied to the whole of the continuous paper P is 10, reference tensions applied to the continuous paper P are equally apportioned by 2 each (the numerals enclosed by double square in the drawing).

Let it be assumed that the coverage of a toner image formed on the photoreceptor drum 12C becomes greater than a reference value so that the electrostatic force of attraction is changed from 1 to 2 as shown in FIG. 6. Because of the electrostatic force of attraction being decreased, the holding and transporting force produced by the photoreceptor drum 12C and transfer roller 24C is decreased. Consequently, the tension applied to the continuous paper P is decreased by 0.5 from 6 to 5.5 at the upstream side of the transfer, and increased by 0.5 from 4 to 4.5 at the downstream side.

As a result, the continuous paper P is subjected to a force that draws it toward the upstream side, so that the transport speed of the continuous paper P is decreased. Consequently, it becomes such that a position where a toner image on the photoreceptor drum 12C is transferred to the continuous paper P occurs earlier, thus resulting in an out-of-superposition state, or a color-to-color misregistration state of toner images.

Therefore, the control unit 101 performs one or more the following procedures (1) to (4), thereby making an exact superposition of toner images on the continuous paper P.

(1) The exposure timing of the LED head 14C is delayed, and thus the forming position of a toner image to be formed on the photoreceptor drum 12C is delayed, to an extent corresponding to a decrease in the speed of the continuous paper P, thereby correcting the timing with which toner images are superposed in a transfer process.

(2) The rotation speed of the photoreceptor drum 12C is delayed to an extent corresponding to a decrease in the speed of the continuous paper P, thereby correcting the timing with which toner images are superposed in a transfer process.

(3) When the electrostatic force of attraction with which the continuous paper P is electrostatically attracted to the photoreceptor drum 12C is small, the transfer bias voltage applied to the transfer roller 24Y is increased so as to increase the electrostatic force of attraction with which the continuous paper P is electrostatically attracted to the photoreceptor drum 12C, thereby keeping constant the transporting force of the continuous paper P as well as the transport speed of the continuous paper P.

(4) When the electrostatic force of attraction with which the continuous paper P is electrostatically attracted to the photoreceptor drum 12C is small, the stabilizer roller 40C is displaced so as to increase the amount of wrap, thereby keeping constant the transporting force of the continuous paper P as well as the transport speed of the continuous paper P.

Meanwhile, when the coverage of a toner image is small and the electrostatic force of attraction is great, the control unit 101 performs a control reverse to the above control.

The control by the control unit 101 will now be described specifically with respect to a case where the forming position of a toner image to be formed on the photoreceptor drum 12 is corrected by exposure timing of the LED head 14 (the above-described procedure (1)).

Figure 7:
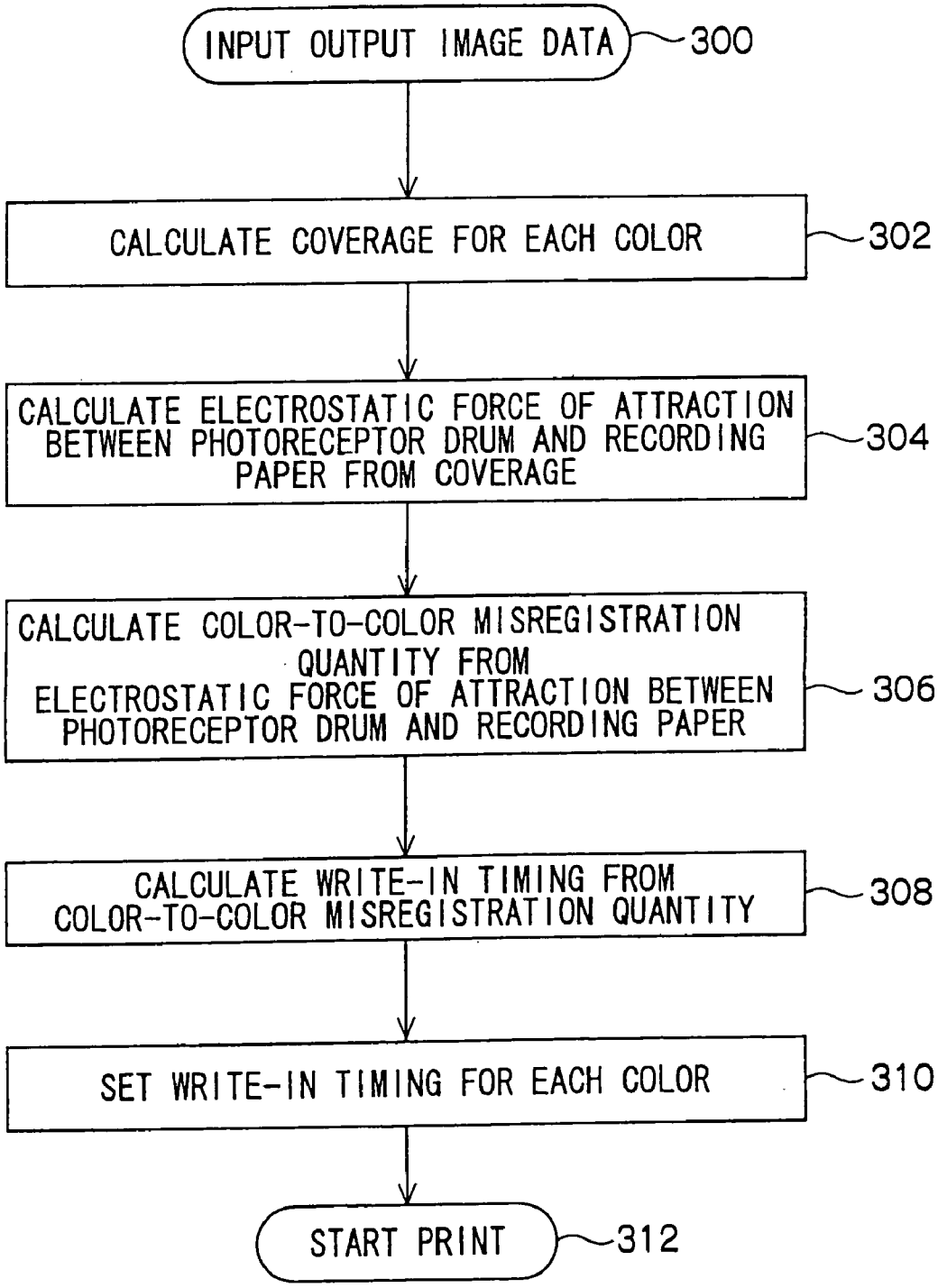
FIG. 7 is a flow chart illustrating a control for correcting a write-in timing.
Figure 8:
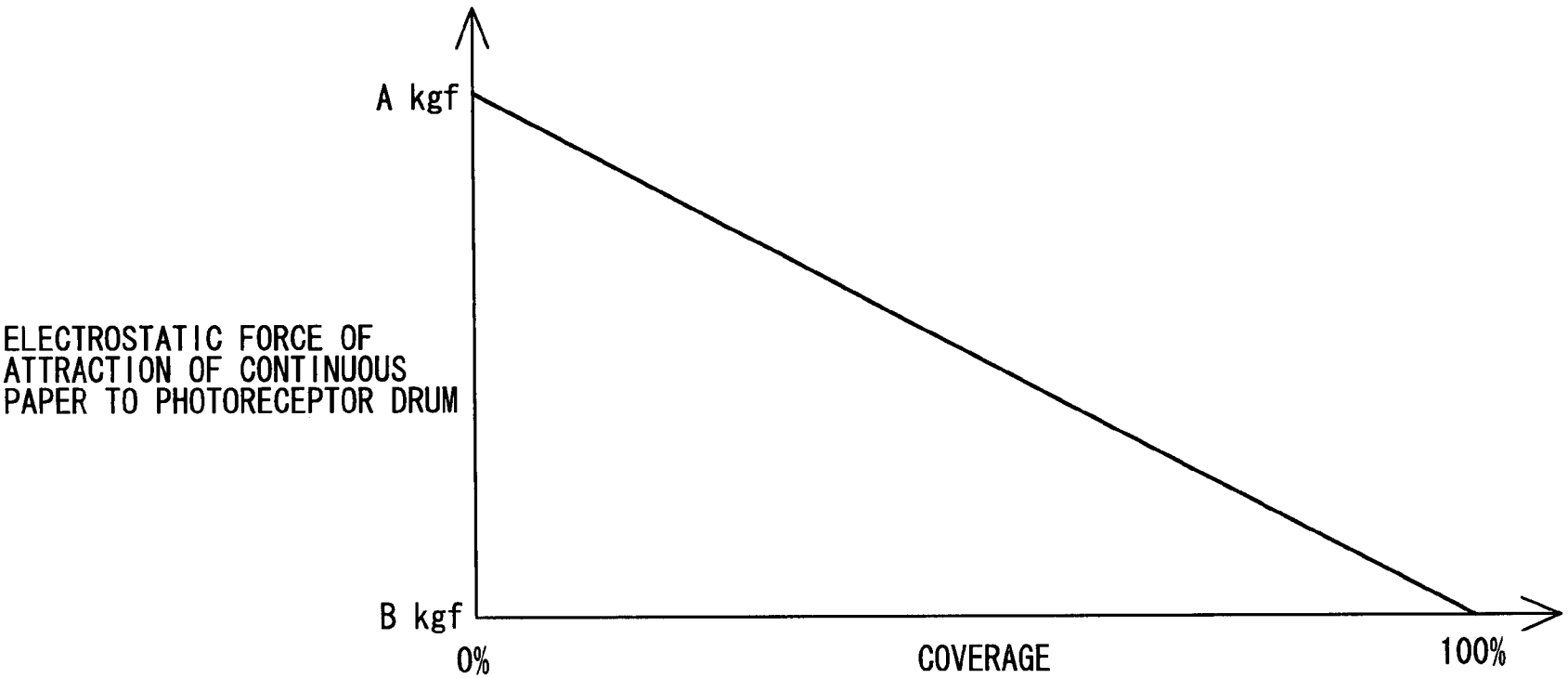
FIG. 8 is a graph showing a relationship between coverage and electrostatic force of attraction of a continuous paper to a photoreceptor drum.
Figure 9:
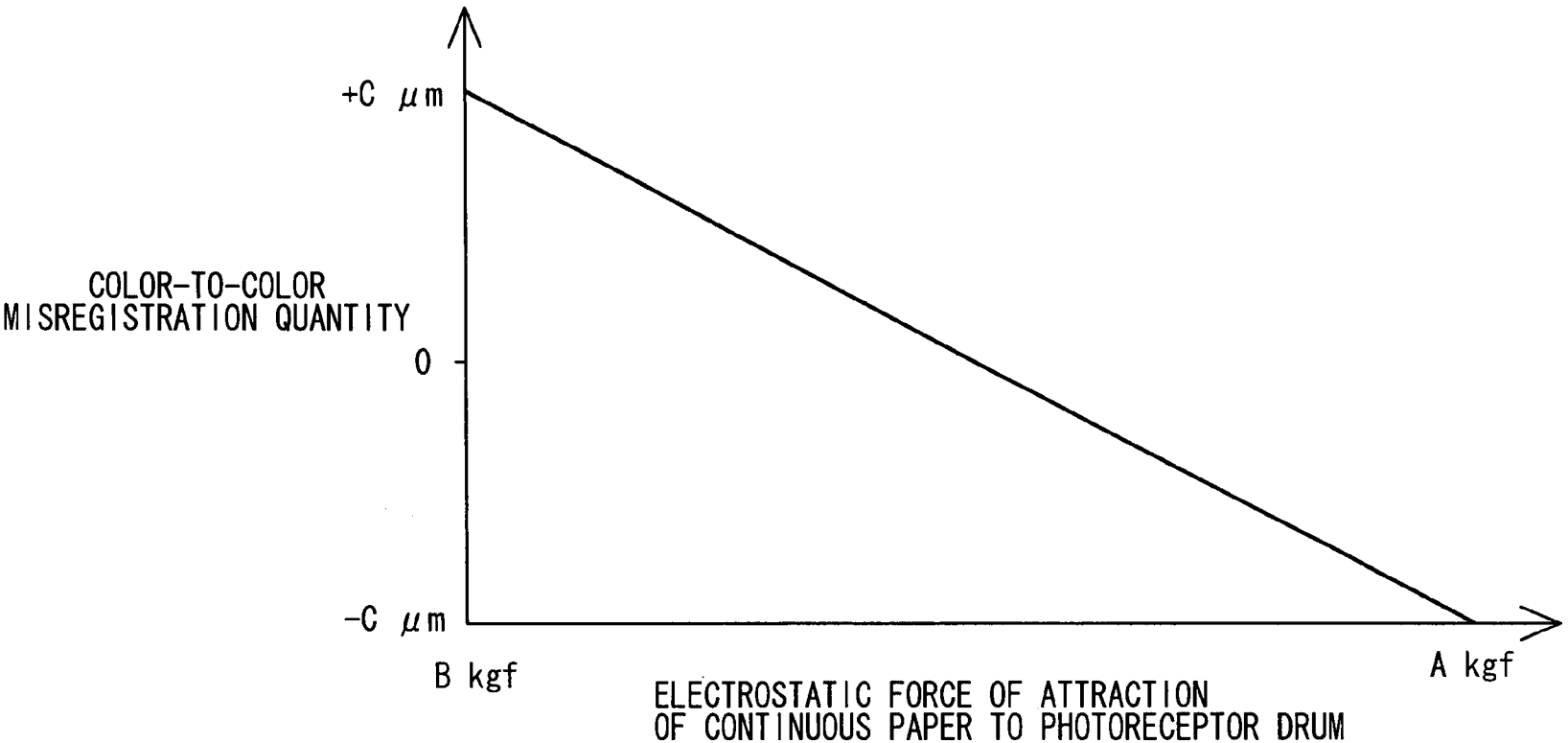
FIG. 9 is a graph showing a relationship between electrostatic force of attraction of a continuous paper to a photoreceptor drum and color-to-color misregistration quantity.
Figure 10:
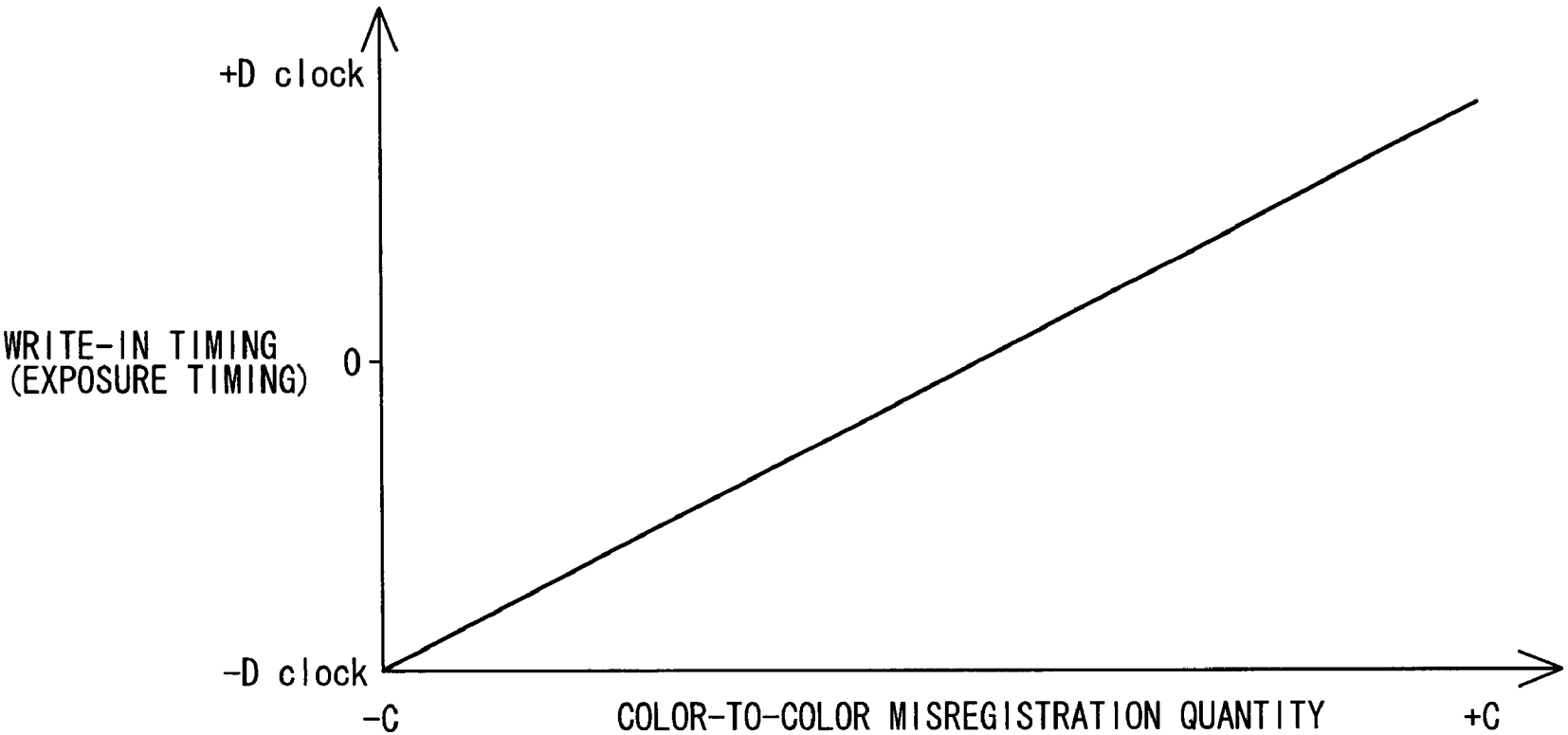
FIG. 10 is a graph showing a relationship between color-to-color misregistration quantity and write-in timing.

FIG. 7 is a flow chart illustrating the control by the control unit 101. FIG. 8 illustrates a relationship between the coverage and the electrostatic force of attraction of the continuous paper P to the photoreceptor drum 12. FIG. 9 shows a relationship between he electrostatic force of attraction of the continuous paper P to the photoreceptor drum 12 and the color-to-color misregistration quantity due to an increase/decrease in the speed of the continuous paper P. FIG. 10 illustrates a relationship between the color-to-color misregistration quantity and the write-in timing of the LED head 14C. Data shown in FIGS. 8 to 10 are prestored in the control unit 101.

Image data outputted at step 300 is inputted to the control unit 101 (see FIG. 1). At step 302, the respective color coverages, or the coverages of respective color toner images to be formed on the respective photoreceptor drums 12Y–K are calculated. At step 304, the electrostatic forces of attraction of the continuous paper P to the respective photoreceptor drums 12Y–K are calculated from the calculated coverages and the data shown in FIG. 8. At step 306, the color-to-color misregistration quantities at the respective photoreceptor drums 12Y–K are calculated from the calculated electrostatic forces of attraction and the data shown in FIG. 9. At step 308, the write-in timings of the respective LED heads 14Y–K are calculated from the calculated color-to-color misregistration quantities and the data shown in FIG. 9. At step 310, the write-in timings of the respective LED heads 14Y–K are set based on the result of calculation of the write-in timings. At step 312, printing is started.

Toner images transferred to the continuous paper P are held between the photoreceptor drum 12 and the continuous paper P in the transfer process. The electrostatic force of attraction of the continuous paper P to the photoreceptor drum 12 is decreased because of the toner images existing therebetween. Further, the electrostatic force of attraction of the continuous paper P to the photoreceptor drum 12 is also varied depending on the coverages of the toner images already transferred to the continuous paper P at the upstream side.

Thus, the control unit 101 (see FIG. 1) also performs control similar to the above-mentioned procedures (1) to (4) based on the coverages of toner images already transferred to the continuous paper P at the upstream side, thereby accurately preventing and correcting a color-to-color misregistration state.

For example, when transferring a cyan toner image on the photoreceptor drum 12C onto the continuous paper P, the control unit 101 also performs controls similar to the above-mentioned procedures (1) to (4) based on the coverages of a yellow toner image and a magenta toner image which have already been transferred to the continuous paper P, thereby preventing and correcting a color-to-color misregistration state. Needless to say, the present invention is by no means limited to the above-described embodiment.

In the above embodiment, description has been made of a developing method in which after the photoreceptor drum 12 has been charged, a toner is adhered to that portion of the drum surface where the surface potential is decreased due to exposure, and then developed, that is, a so-called reversal development process in which the potential difference between a dark portion and a bright portion is reversed by applying a potential substantially equal to the surface potential to a developing electrode, and a toner charged with a polarity identical to that of the surface potential is used. However, it is also possible that a so-called positive development process may be used wherein a toner charged with a polarity opposite to that of a latent image is electrostatically adhered to a portion where surface potential has not been decreased due to exposure.

In the reversal development process, as the coverage of a toner image formed on the photoreceptor drum 12 is increased, the electrostatic force of attraction is decreased, and the transporting force with which the continuous paper P is held and transported by the photoreceptor drum 12 and the transfer roller 24 is decreased. Therefore, a correction is made for decreases in the electrostatic force of attraction and the transporting force when the coverage is increased.

In contrast thereto, in the positive development process, as the coverage of a toner image formed on the photoreceptor drum 12 is decreased, the electrostatic force of attraction is decreased, and the transporting force with which the continuous paper P is held and transported by the photoreceptor drum 12 and the transfer roller 24 is decreased. Therefore, a correction is made for decreases in the electrostatic force of attraction and the transporting force when the coverage is decreased, as opposed to the case of the reversal development process.

While in the above embodiment, the four-color (Y, M, C, K) laser printer 10 has been explained by way of example, it is to be understood that the present invention is by no means limited to a four-color laser printer, and is equally applicable to a five- or more-color laser printer in which other color or colors such as light magenta and the like have been added. Alternatively, the present invention is also applicable to a three- or less-color laser printer.

What is claimed is:

1. An image forming apparatus, comprising:

a print section including a plurality of print units arranged along a transport path for a continuous paper for sequentially transferring respective color toner images in registration onto the continuous paper, wherein each of the plurality of print units includes a rotatable image carrier device, a charger device that charges a surface of the image carrier device at a predetermined surface potential, an exposure device that exposes the image carrier device to decrease the surface potential thereby to form a latent image on the image carrier device, a development device that develops the latent image on the image carrier device into a toner image, and a transfer device, disposed to face the image carrier device across the transport path for the continuous paper, that transfers the toner image on the image carrier device onto the continuous paper;

a continuous paper transport section, provided on an upstream side of a transport direction of the continuous paper, that transports the continuous paper toward the print section;

a fixing section provided on a downstream side of the transport direction of the continuous paper for fixing unfixed toner images onto the continuous paper, the unfixed toner images being formed at the print section and transferred onto the continuous paper;

a tensioning mechanism that imparts a predetermined tension to the continuous paper having the toner images fixed thereon; and a control unit for preventing a color-to-color misregistration state which tends to occur when respective color toner images are sequentially transferred to be overlaid onto the continuous paper, wherein the control unit controls, for each one of the plurality of print units, one or more of an exposure timing of the exposure device, a rotation speed of the image carrier device, and a transfer bias voltage applied to the transfer device, based on a coverage of a toner image formed on the image carrier device.

2. The image forming apparatus according to claim 1, wherein the control unit performs the control based on a coverage of the toner image transferred onto the continuous paper as well as a coverage of a toner image formed on the image carrier device.

3. The image forming apparatus according to claim 1, wherein the image forming apparatus is a four-color laser printer, a five- or more-color laser printer, or a three- or less-color laser printer.

4. An image forming apparatus, comprising:

a print section including a plurality of print units arranged along a transport path for a continuous paper for sequentially transferring respective color toner images in registration onto the continuous paper, wherein each of the plurality of print units includes a rotatable image carrier device, a charger device that charges a surface of the image carrier device at a predetermined surface potential, an exposure device that exposes the image carrier device to decrease the surface potential to form a latent image on the image carrier device, a development device that develops the latent image on the image carrier device into a toner image, a transfer device, disposed to face the image carrier device across the transport path for the continuous paper, that transfers the toner image on the image carrier device onto the continuous paper, and a wrap device that wraps a part of the image carrier device in the continuous paper and capable of adjusting a wrap amount;

a continuous paper transport section, provided on an upstream side of a transport direction of the continuous paper, that transports the continuous paper toward the print section;

a fixing section provided on a downstream side of the transport direction of the continuous paper for fixing unfixed toner images onto the continuous paper, the unfixed toner images being formed at the print section and transferred onto the continuous paper;

a tensioning mechanism that imparts a predetermined tension to the continuous paper having the toner images fixed thereon; and a control unit for preventing a color-to-color misregistration state which tends to occur when respective color toner images are sequentially transferred to be overlaid onto the continuous paper, wherein the control unit controls, for each one of the plurality of print units, one or more of an exposure timing of the exposure device, a rotation speed of the image carrier device, a transfer bias voltage applied to the transfer device, and a wrap amount of the wrap device, based on a coverage of a toner image formed on the image carrier device.

5. The image forming apparatus according to claim 4, wherein a wrap amount of the wrap device is controlled based on a coverage of a toner image formed on each image carrier device.

6. The image forming apparatus according to claim 5, wherein the wrap amount of the wrap device is controlled based on a coverage of a toner image transferred onto the continuous paper as well as a coverage of a toner image formed on each image carrier device.

7. The image forming apparatus according to claim 5, wherein the control unit performs the control based on a coverage of a toner image transferred onto the continuous paper as well as a coverage of a toner image formed on each image carrier device.

8. The image forming apparatus according to claim 4, wherein the wrap device comprises: a pair of stabilizer rollers provided on an upstream side and on a downstream side of each transfer device to face the image carrier device across the transport path for the continuous paper; and a stabilizer moving device that moves a position of each stabilizer roller; wherein the wrap amount is controlled by controlling the stabilizer moving device.

9. The image forming apparatus according to claim 4, wherein the image forming apparatus is a four-color laser printer, a five- or more-color laser printer, or a three- or less-color laser printer.

* * * * *